US005133996A

United States Patent [19]

Busker

[11] Patent Number: 5,133,996

[45] Date of Patent: Jul. 28, 1992

[54] METHOD AND APPARATUS FOR COATING A WEB

[75] Inventor: L. H. Busker, Rockton, Ill.

[73] Assignee: Beloit Corporation, Beloit, Wis.

[21] Appl. No.: 784,289

[22] Filed: Oct. 29, 1991

[51] Int. Cl.[5] ..... B05C 5/02; B05D 1/26

[52] U.S. Cl. ..... 427/356; 118/410; 118/413; 118/419

[58] Field of Search ..... 118/410, 413, 419; 427/356, 357, 358

[56] References Cited

U.S. PATENT DOCUMENTS 4,495,888 1/1985 Wörle et al. ..... 118/410
4,594,963 6/1986 Krautzberger ..... 118/413 X
5,010,840 4/1991 Busker et al. ..... 118/410

*Primary Examiner*—Michael G. Wityshyn

*Attorney, Agent, or Firm*—Dirk J. Veneman; Raymond W. Campbell; David J. Archer

[57] ABSTRACT

A coating apparatus and method is disclosed for applying coating material onto a web supported by a backing member. The apparatus includes a housing which is disposed closely adjacent to the backing member. The arrangement is such that the web supported by the backing member moves between the backing member and the housing. The housing defines a chamber having an open end facing towards the backing member. A coating shoe slidably cooperates with the web, the shoe being movably disposed within the chamber. The shoe defines a cavity which is connected to a source of pressurized coating material. The cavity has an exposed face towards the web such that the coating material flows into the cavity and through the exposed face for applying the material onto the web.

11 Claims, 1 Drawing Sheet

FIG. 1
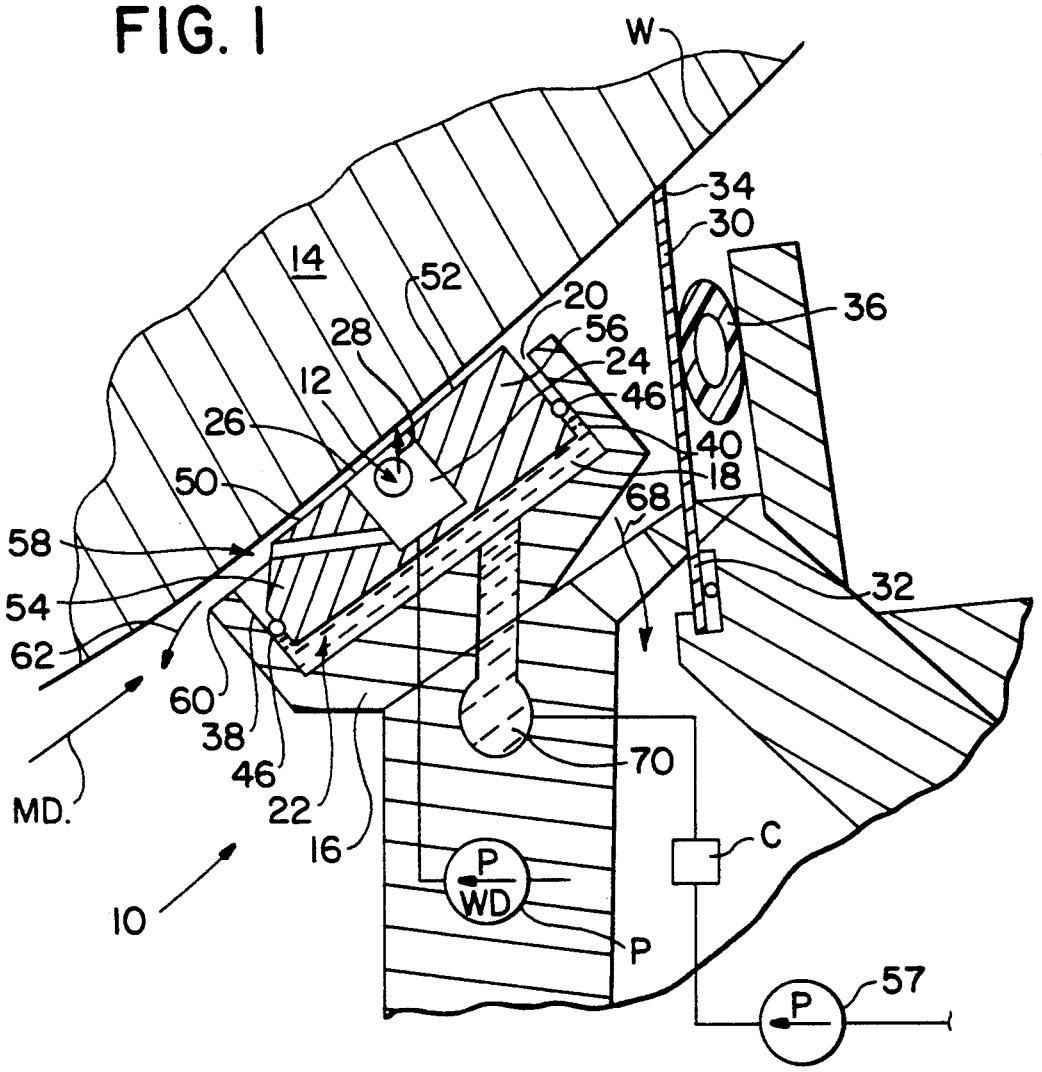
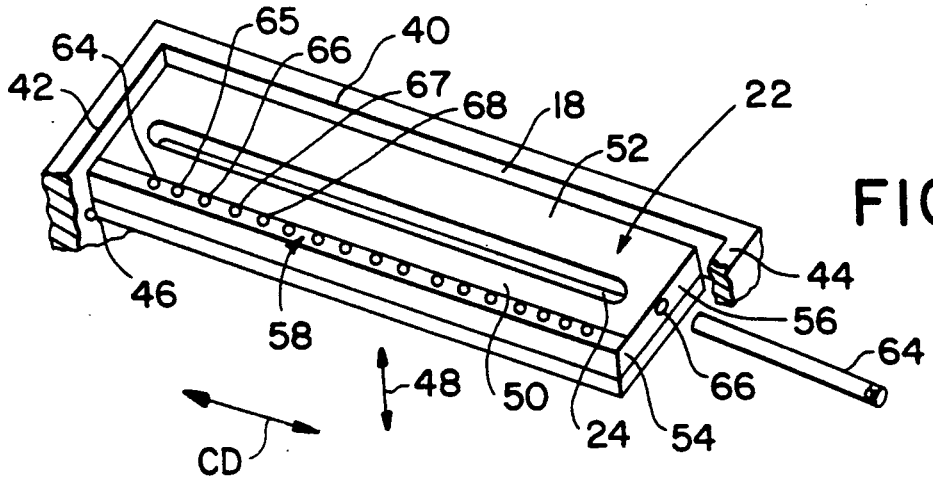
FIG. 2

METHOD AND APPARATUS FOR COATING A WEB

BACKGROUND OF THE INVENTION

1. Field of the Invention

The present invention relates to a coating apparatus and method for applying coating material onto a web supported by a backing member. More particularly, the present invention relates to a coating apparatus and method for applying pressurized coating material onto a web of paper.

2. Information Disclosure Statement

In the web coating art, coating material is applied to a rotating roll and offset onto an application roll such that a web contacting the application roll takes up a portion of the coating material. However, such coating apparatus tends to saturate the web with coating material so that excessive quantities of coating material are applied.

More recently, the so-called short dwell coater has proved very successful in reducing the amount of coating material absorbed by the web when compared with the aforementioned prior art pond coating methods.

Essentially, the short dwell coater includes a housing defining an application zone supplied with a source of pressurized coating material. A web of paper moves past an open face of the application zone while supported by a backing member, such as a backing roll. A doctor blade is disposed immediately downstream relative to the application zone for removing excess coating material applied to the web through the open face of the application zone. Consequently, the dwell time of the web relative to the coating material in the application zone is minimal so there is very little time for the coating material to be absorbed by the web.

Nevertheless, with a short dwell coater, the pressure at which the coating material is supplied must be relatively low in order to prevent excessive flow over the baffle, that is the leading wall, and loss of coat weight control due to pressure on the blade, sometimes exhibited as streaking of the resultant coated web.

U.S. Pat. No. 5,010,840 to Busker et al proposed a short dwell coater having an overflow weir between the application zone and the doctor blade such that excess coating material could be recirculated.

However, in certain applications, it has been desirable to apply to the coating material a greater pressure than that possible with the aforementioned short dwell coater.

Accordingly, the present invention relates to an apparatus and method of applying a coating material to the surface of the sheet using a shoe with coating material supplied to the leading edge of the shoe and to a cavity near the center of the shoe. The shoe can be followed by a blade if required in accordance with the coating weight to be applied to the web.

The advantages of the aforementioned arrangement include the development of pressures in the application zone that are much higher than can be developed in a short dwell coater head while eliminating the disadvantages of the prior art coating ponds and the like where vortexing within the coating material is a problem.

The present invention provides a means for applying coating material to sheet material and eliminates air entrainment and vortexing of the coating material within the application zone, thereby providing coating uniformity at even higher speeds.

More specifically, the application of coating material to a web using the short dwell coating head has many advantages. Among such advantages are good runnability and clean operation. However, at operating speeds above 3,000 feet per minute, machine directional streaks and mottling appear on the applied coating. Such streaks are thought to be the result of vortexing that develops in the pond or application zone of the short dwell coater head.

The aforementioned offset application roll technique, otherwise known as "flooded nip coating", uses a roll to apply the coating to the sheet and has less of a problem with streaks. However, the flooded nip coater includes other problems, such as non-uniformity of the resultant coating material and the lack of cleanliness.

The present invention provides means for applying coating to the sheet using an application shoe, thereby eliminating the development of vortices in the pond. Additionally, the present invention gives a measure of control over the thickness of the coating film being applied to the sheet.

By mounting the shoe such that it is able to move freely towards and away from the web, the runnability of the arrangement is preserved.

Additionally, by keeping the shoe relatively small and in a confined space, an increase in cleanliness during operation of the apparatus is achieved.

Therefore, it is a primary objective of the present invention to provide a coating apparatus which overcomes the aforementioned inadequacies of the prior art arrangements and which makes a considerable contribution to the art of coating material onto a paper web.

Another object of the present invention is the provision of a coating apparatus which includes a shoe for eliminating the development of vortices in an application zone.

Another object of the present invention is the provision of a coating apparatus which, in use thereof, exhibits enhanced cleanliness.

Other objects and advantages of the present invention will be readily apparent to those skilled in the art by a consideration of the detailed description taken in conjunction with the annexed drawings.

SUMMARY OF THE INVENTION

The present invention relates to a coating apparatus and method for applying coating material onto a web supported by a backing member. The apparatus includes a housing which is disposed closely adjacent to the backing member. The arrangement is such that the web supported by the backing member moves between the backing member and the housing. The housing defines a chamber having an open end. The open end faces towards the backing member.

A coating shoe slidably cooperates with the web. The shoe is movably disposed within the chamber and defines a cavity which is connected to a source of pressurized coating material.

The cavity has an exposed face towards the web such that the coating material flows into the cavity and through the exposed face for applying the material onto the web.

In a more specific embodiment of the present invention, the coating apparatus also includes a doctor blade having a proximal and a distal end. The proximal end is adjustably secured to the housing. The distal end of the doctor blade bears against the coating material applied to the web for removing excess coating material from the web.

The coating apparatus also includes an air tube means disposed between the proximal and distal ends of the blade and the housing for adjusting the pressure applied to the blade such that removal of excess coating material from the web is controlled.

The chamber includes a leading and a trailing wall, the walls being spaced and parallel relative to each other.

Additionally, the chamber includes a first and a second side wall which extend between the leading and the trailing walls. The side walls are spaced and parallel relative to each other for the slidable reception therein of the coating shoe.

The chamber is connected to a pressurized fluid source, and control means are disposed between the pressurized fluid source and the chamber for controlling the pressure within the chamber for adjusting the pressure exerted by the coating shoe on the web.

The coating apparatus also includes seal means disposed between the coating shoe and the housing. The arrangement is such that the shoe, the sealing means and the housing define therebetween the chamber so that the coating shoe is permitted to move towards and away from the web.

Furthermore, the shoe defines a leading and a trailing face which conform to the backing member for facilitating movement of the web therepast.

The coating shoe defines a leading and a trailing portion, the cavity being disposed between the leading and the trailing portion. Additionally, the cavity is connected to a variable pressure source of the coating material.

The leading portion defines a plurality of channel means extending substantially in a machine direction from the cavity through the leading portion such that when the coating apparatus is operating at such a speed that the coating material flows from the cavity past the trailing portion and between the trailing portion and the web, and when the flow of coating material between the leading portion and the web decreases, coating material flows through the channel means for providing a wedge of coating material between the leading portion and the web.

The coating apparatus also includes an overflow means for permitting some of the coating material flowing through the channel means to overflow in a direction opposite to the direction of movement of the web.

More specifically, the channel means includes a plurality of channels extending from the cavity through the leading portion. The channels are disposed spaced and parallel to each other in a cross-machine direction.

Many modifications and variations of the present invention will be readily apparent to those skilled in the art by a consideration of the detailed description taken in conjunction with the annexed drawings. However, such modifications and variations do not depart from the spirit and scope of the present invention as defined by the appended claims.

BRIEF DESCRIPTION OF THE DRAWINGS

FIG. 1 is a sectional view of the coating apparatus according to the present invention; and FIG. 2 is an enlarged fragmentary perspective view of the coating shoe shown in FIG. 1.

Similar reference characters refer to similar parts throughout the various figures of the drawings.

DETAILED DESCRIPTION OF THE DRAWINGS

FIG. 1 is a sectional view of a coating apparatus, generally designated 10, for applying coating material 12 onto a web W supported by a backing member 14. The apparatus 10 includes a housing 16 disposed closely adjacent to the backing member 14 such that the web W supported by the backing member 14 moves between the backing member 14 and the housing 16. The housing 16 defines a chamber 18 having an open end 20. The open end 20 faces towards the backing member 14.

A coating shoe, generally designated 22, slidably cooperates with the web W. The shoe 22 is movably disposed within the chamber 18. The shoe 22 defines a cavity 24 which is connected to a source of pressurized coating material P. The cavity 24 has an exposed face 26 towards the web W such that the coating material 12 flows, as indicated by the arrow 28, into the cavity 24 and through the exposed face 26 for applying the coating material 12 onto the web W.

The coating apparatus 10 also includes a doctor blade 30 having a proximal and a distal end 32 and 34, respectively. The proximal end 32 is adjustably secured to the housing 16. The distal end 34 bears against the coating material 12 applied to the web W for removing excess coating material 12 from the web W.

The coating apparatus 10 also includes air tube means 36 disposed between the proximal and distal ends 32 and 34, respectively, of the blade 30 and the housing 16 for adjusting the pressure applied to the blade 30 such that removal of excess coating material 12 from the web W is controlled.

The chamber 18 also includes a leading and a trailing wall 38 and 40, respectively. The walls 38 and 40 are spaced and parallel relative to each other.

FIG. 2 is an enlarged fragmentary perspective view of the shoe 22 within the chamber 18. As shown in FIG. 2, the chamber 18 also includes a first and a second side wall 42 and 44, respectively, which extend between the leading and the trailing walls 38 and 40. The side walls 42 and 44 are spaced and parallel relative to each other for the slidable reception therein of the coating shoe 22.

The chamber 18 is connected to a pressurized fluid source 57. Control means C are disposed between the pressurized fluid source 57 and the chamber 18 for controlling the pressure within the chamber 18 for adjusting the pressure exerted by the coating shoe 22 on the web W.

As shown in FIG. 1, the coating apparatus 10 also includes seal means 46 disposed between the coating shoe 22 and the housing 16. The arrangement is such that the shoe 22, the sealing means 46 and the housing 16 define therebetween the chamber 18. The coating shoe 22 is permitted to move towards and away from the web W, as indicated by the arrow 48, as shown in FIG. 2.

Additionally, the shoe 22 defines a leading and a trailing face 50 and 52, respectively, which conform to the backing member 14 for facilitating movement of the web W therepast.

Preferably, the backing member 14 is a backing roll, and the leading and trailing faces 50 and 52, respectively, have a radius of curvature substantially the same as the radius of curvature of the backing member or roll 14 such that the leading and trailing faces 50,52 are concave.

The coating shoe 22 defines a leading and a trailing portion 54 and 56, respectively. The cavity 24 is disposed between the leading and the trailing portions 54 and 56. The cavity 24 is connected to a variable pressure source P of the coating material 12. The leading portion 54 defines a plurality of channel means, generally designated 58, extending substantially in a machine direction, as indicated by the arrow MD, from the cavity 24 through the leading portion 54. The arrangement is such that when the coating apparatus 10 is operated at such a speed that the coating material 12 flows from the cavity 24 past the trailing portion 56 and between the trailing portion 56 and the web W, and when the flow of coating material 12 between the leading portion 54 and the web W decreases, coating material 12 flows through the channel means 58 for providing a wedge of coating material between the leading portion 54 and the web W.

More specifically, the coating apparatus 10 includes overflow means 60 for permitting some of the coating material 12 flowing through the channel means 58 to overflow in a direction, as indicated by the arrow 62, opposite to the direction, as indicated by the arrow MD, of movement of the web W.

Preferably, the channel means 58 includes a plurality of channels 64,65,66,67 and 68 which extend from the cavity 24 through the leading portion 54. The channels 64 to 68 are disposed spaced and parallel to each other in a cross-machine direction, as indicated by the arrow CD shown in FIG. 2.

In operation of the coating apparatus 10, coating material 12 is applied to the cavity 24 via a supply tube 64 connected to a conduit 66 extending through the shoe 22. The arrangement is such that the pressurized coating material 12 flows through the cavity 24 and through the exposed face 26 so that the coating material is applied to the web W.

At relatively low application speeds, the coating material will flow respectively between the web and the leading face 50 and between the web and the trailing face 52.

However, as the application speed increases, a greater proportion of the coating material tends to flow between the web and the trailing face 52, and less coating material flows from the cavity 24 between the web and the leading face 50.

Consequently, in order to inhibit frictional engagement of the leading face 50 with the web, coating material 12 is supplied through the channel means 58, thereby supplying a wedge of coating material that tends to flow in the direction MD between the web and the leading face 50.

Excess coating material 62 flowing through channel means 58 flows through the overflow 60 in a direction generally opposite to the machine direction MD. Such excess coating material may be collected and recirculated.

Additionally, excess coating material 12 removed from the web W by the distal end 34 of the doctor blade 30 flows through a further overflow, as indicated by the arrow 68, for cleaning and recirculation thereof.

During operation of the coating apparatus 10, pressurized fluid is applied to the chamber 18 through supply tube 70. Such pressurized fluid may be the coating material 12, water or any other suitable fluid.

By controlling the pressure of the fluid within the chamber 18, the shoe 22 may be adjustably moved towards and away from the web according to the desired thickness of the coating to be applied. The coating thickness that develops on the face or faces of the shoe is a function of the loading on the backside of the shoe, the shoe length in a machine direction and the pressure and flow of the coating material within the cavity 24. Such coating thickness is also dependent on the viscosity of the coating material and the temperature of application.

At low machine speeds and with a coating material having a low viscosity, coating will flow in the forward and reverse directions over the leading and trailing faces of the shoe. However, as stated hereinbefore, at high machine speed and with a coating material having a high viscosity, all of the flow will go to the trailing face of the shoe and the leading face could become starved of coating material and begin to rub against the web.

Under the aforementioned conditions, it is necessary to supply coating to the leading edge of the shoe by means of the plurality of channels 64 to 68. Alternatively, the channels could be a plurality of slots.

By the present invention, it is possible at high loading of the shoe to achieve a film thickness leaving the shoe that equals the film thickness produced using the blade. In such a case, the blade becomes redundant and may be removed.

The present invention provides a coating apparatus which eliminates the generation of vortices within a coating application zone while additionally maintaining the cleanliness of the apparatus during operation thereof.

What is claimed is:

1. A coating apparatus for applying coating material onto a web supported by a backing member, said apparatus comprising:

a housing disposed closely adjacent to a backing member such that a web supported by the backing member moves between the backing member and said housing, said housing defining a chamber having an open end, said open end facing towards the backing member; and a coating shoe slidably cooperating with the web, said shoe being movably disposed within said chamber, said shoe defining a cavity which is connected to a source of pressurized coating material, said cavity having an open side facing towards the web such that the coating material flows into said cavity and through said face open side for applying the material onto the web.

2. A coating apparatus as set forth in claim 1, further including:

a doctor blade having a proximal and a distal end, said proximal end being adjustably secured to said housing, said distal end bearing against the coating material applied to the web for removing excess coating material from the web.

3. A coating apparatus as set forth in claim 2, further including:

air tube means disposed between said proximal and distal ends of said blade and said housing for adjusting the pressure applied to said blade such that removal of excess coating material from the web is controlled.

4. A coating apparatus as set forth in claim 1, wherein said chamber includes:

a leading and a trailing wall, said walls being spaced and parallel relative to each other;

a first and a second side wall extending between said leading and trailing walls, said side walls being spaced and parallel relative to each other for the slidable reception therein of said coating shoe;

said chamber being connected to a pressurized fluid source;

control means disposed between said pressurized fluid source and said chamber for controlling the pressure within said chamber for adjusting the pressure exerted by said coating shoe on the web.

5. A coating apparatus as set forth in claim 1, further including:

seal means disposed between said coating shoe and said housing, the arrangement being such that said shoe, said sealing means and said housing define therebetween said chamber so that said coating shoe is permitted to move towards and away from the web.

6. A coating apparatus as set forth in claim 1, wherein:

said shoe defines a leading and a trailing face which conform to the backing member for facilitating movement of the web therepast.

7. A coating apparatus as set forth in claim 1, wherein:

said coating shoe defines a leading and a trailing portion, said cavity being disposed between said leading and said trailing portions, said cavity being connected to a variable pressure source of the coating material;

said leading portion defining a plurality of channel means extending substantially in a machine direction from said cavity through said leading portion such that when the coating apparatus is operating at such a speed that the coating material flows from said cavity past said trailing portion and between said trailing portion and the web and when the flow of coating material between said leading portion and the web decreases, coating material flows through said channel means for providing a wedge of coating material between said leading portion and the web.

8. A coating apparatus as set forth in claim 7, further including:

overflow means for permitting some of the coating material flowing through said channel means to overflow in a direction opposite to the direction of movement of the web.

9. A coating apparatus as set forth in claim 7, wherein said channel means includes:

a plurality of channels extending from said cavity through said leading portion, said channels being disposed spaced and parallel to each other in a cross-machine direction.

10. A coating apparatus for applying coating material onto a web supported by a backing member, said apparatus comprising:

a housing disposed closely adjacent to a backing member such that a web supported by the backing member moves between the backing member and said housing, said housing defining a chamber having an open end, said open end facing towards the backing member, said chamber being connected to a pressurized fluid source;

a coating shoe slidably cooperating with the web, said shoe being movably disposed within said chamber, said shoe defining a cavity which is connected to a source of pressurized coating material, said cavity having an open side facing towards the web such that the coating material flows into said cavity and through said open side for applying the material onto the web;

said coating shoe further including:

a leading portion and a trailing portion, said cavity being disposed between said leading and said trailing portions; and said leading portion defining a plurality of channel means for providing a wedge of coating material between said leading portion and the web.

11. A method for applying coating material onto a web supported by a backing member, said method comprising the steps of:

moving a web supported by a backing member such that the web is disposed between the backing member and a housing which defines a chamber having an open end, the open end facing towards the backing member; and urging a coating shoe into cooperating relationship with the web, the shoe being movably disposed within the chamber, the shoe defining a cavity which is connected to a source of pressurized coating material, the cavity having an open side facing towards the web, the arrangement being such that the coating material flows into the cavity and through the open side for applying the material onto the web.

* * * * *